United States Patent [19]

Nagao

[11] Patent Number: 5,050,881

[45] Date of Patent: Sep. 24, 1991

[54] SLOT MACHINE

[75] Inventor: Yuji Nagao, Tokyo, Japan

[73] Assignee: Sigma, Incorporated, Tokyo, Japan

[21] Appl. No.: 584,497

[22] Filed: Sep. 17, 1990

Related U.S. Application Data

[63] Continuation of Ser. No. 239,400, Sep. 1, 1988, abandoned.

[51] Int. Cl.[5] ..... A63F 9/24

[52] U.S. Cl. ..... 273/143 R; 273/138 A

[58] Field of Search ..... 273/138 R, 138 A, 143 R; 364/410, 412, 717

[56] References Cited

U.S. PATENT DOCUMENTS

| | | | |
|---|---|---|---|
| 4,095,795 | 6/1978 | Saxton et al. | 273/143 R |
| 4,527,798 | 7/1985 | Siekierski et al. | 364/717 |
| 4,573,681 | 3/1986 | Okada | 273/143 R |
| 4,675,506 | 6/1987 | Crouch | 273/143 R |
| 4,712,799 | 12/1987 | Fraley | 273/138 X |
| 4,817,951 | 4/1989 | Crouch et al. | 273/138 A |

*Primary Examiner*—Edward M. Coven
*Assistant Examiner*—Jessica J. Harrison
*Attorney, Agent, or Firm*—Beveridge, DeGrandi & Weilacher

[57] ABSTRACT

This invention relates to a slot machine which comprises random number generating unit and X reels each having a plurality of symbols. All the combinations of the symbols among the reels made when one symbol of each reel is selected are identified by respective numbers, and one random number is generated by the random number generating unit, so that a combination of the symbols bearing an identification number corresponding to the random number is selected.

16 Claims, 4 Drawing Sheets

SLOT MACHINE

This application is a continuation of application Ser. No. 07/239,400, filed Sept. 1, 1988, now abandoned.

BACKGROUND OF THE INVENTION

1. Field of the Invention

This invention relates to a slot machine comprising random number generating means and X reels having a plurality of symbols arranged thereon in which symbols of the respective reels are selected based on a random number.

2. Related Background Art

In the conventional slot machine of this type, different random numbers are supplied to respective reels in every game, and after the reels are rotated simultaneously, symbols (stop positions) of the respective reels are selected based on their respective random numbers.

But in such slot machine, in order to converge an actual pay out to a pay out ratio which is determined by kinds and numbers of winning combinations of symbols and numbers of coins to be paid, games have to be played infinite times.

In the conventional slot machine described above, it can happen that wins which pay a number of coins are concentrated in a short period of time or conversely do not take place for a long period of time.

SUMMARY OF THE INVENTION

A first object of this invention is to provide a slot machine which is capable of converging a pay out result to a preset pay out ratio in a limited period of time.

A second object of this invention is to provide a slot machine which is capable of adjusting a period of time in which a pay out result converges to a preset pay out ratio.

A third object of this invention is to provide a slot machine which is capable of suitably distributing wins which pay large numbers of coins.

A fourth object of this invention is to provide a slot machine which comprises random number generating means and X reels each having a plurality of symbols, whereby one symbol of each reel is selected based on a random number generated by the random number generating means for every game, and in which all the combinations of the symbols made when one symbol of each reel is selected are identified by respective numbers, and one random number is generated by the random number generating means, so that a combination of the symbols bearing an identification number corresponding to the random number that is selected.

DESCRIPTION OF THE PREFERRED EMBODIMENT

Figure 1:
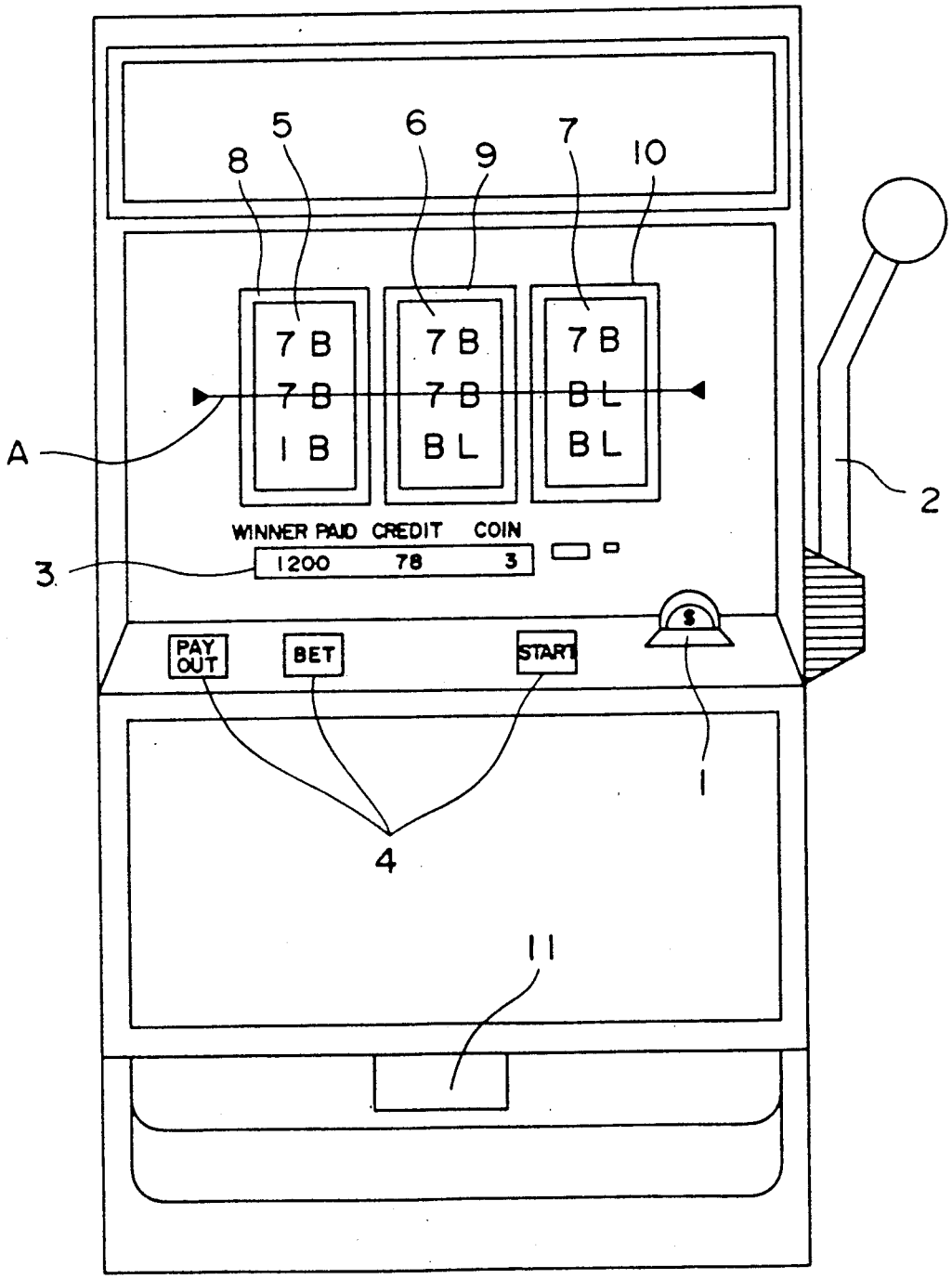
FIG. 1 is a plan view of the appearance of the slot machine according to one embodiment of this invention.
Figure 2:
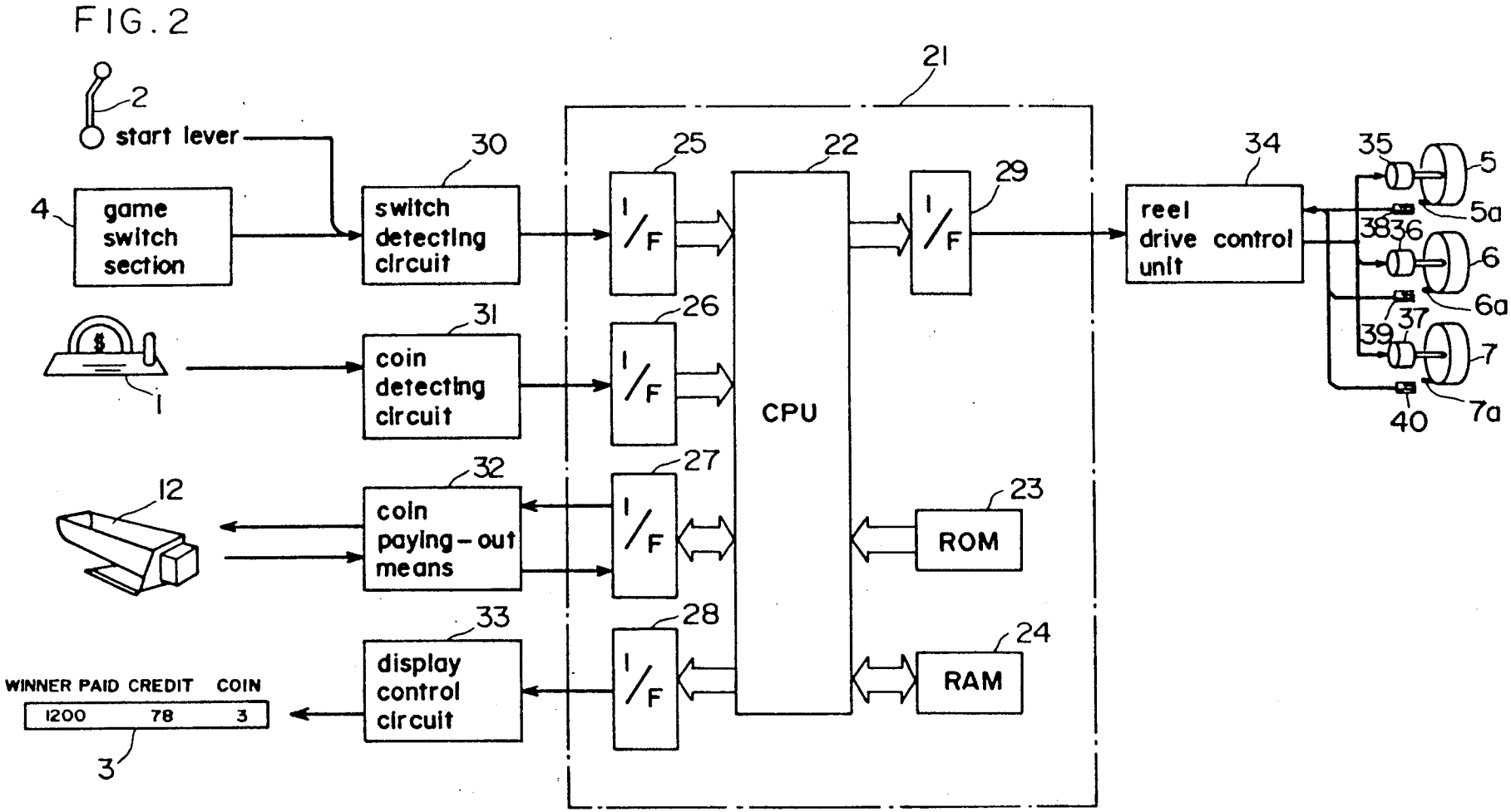
FIG. 2 is a block diagram of the internal mechanism of the slot machine according to the embodiment.

Firstly, how to play the slot machine according to this embodiment will be explained. The slot machine according to this embodiment is one of the mechanical reel type that comprises three reels 5,6,7. A player firstly inserts a certain number of coins into a slot 1 of the slot machine.

Next, the player pulls a start lever 2 or pushes a Start button in a switch section 4, the three reels 5,6,7 begin to rotate simultaneously. Thirty two (32) symbols are drawn on the peripheral surface of each reel 5,6,7. The series of the symbols on the reels are seen to move through their associated display windows 8,9,10. But the series of the symbols are moved so fast that the symbols cannot be identified. When a certain period of time passes after the reels 5,6,7 start to rotate, the reels 5,6,7 stop one after another. At this time, if three symbols aligned along a winning line A agree with a preset winning combination of the symbols, a number of coins corresponding to the winning combination of the symbols is paid at a coin discharge opening 11, and the number of the paid coins is displayed at a certain position in a display section 3. If the combination of the symbols aligned along the winning line A does not agree with a preset winning combination of the symbols, no coin is paid. Thus one game is completed.

When a game is played after a Bet button in the switch section 4 is pushed, coins at winning are not paid out, and instead the number of the coins at winning is displayed at "Credit" in the display section 3. The displayed number is an equivalent to the number of coins. When the Bet button in the switch section 4 is pushed once, 1 is added to the number displayed at "Coin" in the display section 3, while 1 is subtracted from the number displayed at "Credit".

When a pay out switch in the switch section 4 is pushed, the same number of coins as that displayed at "Credit" in the display section 3 is paid out at the coin discharge opening 11.

The slot machine according to this embodiment of this invention is played in the above described mode.

Next, the internal mechanism of the slot machine according to this embodiment will be explained. A microcomputer 21 generally controls the slot machine. The microcomputer 21 is operated mainly by a central processing unit (CPU) 22 and comprises a read only memory (ROM) 23, a random access memory (RAM) 24, and interfaces 25~29 for connections with external circuits. ROM 23 stores main programs, and various other programs. RAM 24 is a memory which timely writes and reads necessary data during an operation and can retain its memories for about one month by a back up power source even in a case of a blackout or an unexpected break off of a power source.

The interface 25 is for introducing the signal from a switch detecting circuit 30 to CPU 22. The switch detecting circuit 30 detects the operational state of a start lever 2, and the buttons in the switch section 4. The interface 26 is for introducing the signal from a coin detecting circuit 31 to CPU 22. The coin detecting circuit 31 counts the number of coins inserted into the slot 1. The interface 27 is for supplying the signal from CPU 22 to coin paying out means 32 and introducing the signal from the coin paying out means 32 to CPU 22. The coin paying out means 32 drives a coin paying out hopper in response to a command of CPU 22 and pays out a number of coins required by the command onto a tray 12 in the coin discharging opening 11. Besides, the coin paying out means 32 informs CPU 22 through the interface 27 of a lack of stored coins and a failure of the coin paying out means 32 per se. The interface 28 is for supplying the signal from CPU 22 to a display control circuit 33. The display control circuit 33 controls the respective displays in the display section 3. The interface 29 is for supplying the signal from CPU 22 to a reel drive control circuit 34. The reel drive control circuit 34 controls the stop and the drive of stepping motors 35~37 which drive the reels 5,6,7 respectively and can stop the respective reels 5,6,7 at required stop positions using the detected outputs from photosensors 38~40 which detect positioning projections 5*a*~7*a* provided on the respective reels 5,6,7. That is, the stop position of each reel can be controlled by controlling the number of drive steps after a detection of the positioning projection.

Next, the operation of the slot machine according to this embodiment will be explained. In the slot machine according to this embodiment, the symbols on the reels are chosen based on a random number. To this end CPU 22 has a function of generating random numbers. A characteristic of the slot machine is that the respective reels are not supplied independently and separately with random numbers to select their respective symbols independently. Rather all combinations of symbols, represented by the selection of a symbol from each reel, are considered and a combination of symbols for a game is selected based on a random number.

Thirty two (32) symbols are drawn on each reel 5,6,7. That is, each reel has 32 stop positions. Accordingly, $32\times32\times32=32768$ combinations of the symbols are obtained. Assuming that all the combinations of the symbols have appeared unrepeatedly one by one at the end of 32768 games, a pay out resultantly converges to an originally set pay out ratio. In this way, the best convergence ratio can be achieved. In this embodiment, each combination of the symbols is identified by different numbers. Specifically, the combination of the symbols in which a first reel 5, a second reel 6 and a third reel 7 all stop at their first stop positions [1 1 1] is identified by a 0th combination. In this way, a combination [1 1 2] is identified by a 1st combination; [1 1 3], by a 2nd combination. All the 32768 combinations from 0th to 32767th combinations are identified by identification numbers. These identification numbers are chosen by a random number for each game, so that fair games are played. When 32768 games are finished, all the combinations have appeared, or when $32768\times n$ games are finished, all the combinations have appeared n times, a resultant pay out agrees with an originally set pay out ratio.

Next, the generation of random numbers will be explained. In this embodiment, 24 bit M sequence random numbers are used as the most basic random numbers. M sequence is the abbreviation for maximum-length linearly recurring sequence. The 24 bit M sequence random numbers are $2^{24}$ (16777216) random numbers from 0 to 16777215 which appear one by one at random and each of which never appears repeatedly. That is, 0 to 16777215 numbers are arranged at random in one period of the 24 bit M sequence random numbers.

On the other hand, as described above, the combinations of the symbols are 32768. The number of the 24 bit M sequence random numbers is 16777216, which is 512 times the number of the combinations of the symbols, 32768. If all the random numbers are used, when $32768\times512$ games are finished, each of the combinations of the symbols has appeared 512 times. At this time, a resultant pay out converges to an original pay out ratio. A random number and an identification number are caused to correspond to each other in the following way. That is, the random numbers are divided by the total number of the combinations of the symbols, and a combination having the same identification number as the remainder will be chosen. For example, Assuming the random number 67282 appears, the calculation $$67282\div32768=2\ldots1746$$

is made, and a combination of the symbols identified by the same number as the remainder 1746 will be chosen.

But assuming that 2000 games are played a day, 2000 random numbers out of the 24 bit M sequence random numbers will be used, and it will take about 23 years for $32768\times512$ games to be finished.

Then, in order that a pay out ratio converges in a shorter period of time, the following processing will be made.

First, the random number sequence of 0 to 16777215 making up the 24 bit M sequence random numbers is divided into 512 segments each having 32768 figures. That is, a first segment includes 0~32767 numbers; a second segment, 32768~65535 numbers; and a third segment, 655536~98303 numbers. In this way, the sequence of 0~16777215 numbers is divided into 512 segments. Next, among the first to the 512th segments, a segment is chosen at random. Further, only when a random number generated from the 24 bit M sequence random numbers is within the chosen segment, the random number is used to select a combination of the symbols.

Assuming that the third segment is chosen, only when a random number generated from the 24 bit M sequence random numbers is within 655536~98303, the random number will be used to choose a combination of the symbol. Now assuming the 24 bit M sequence random numbers appear in the sequential order of (1) 32, (2) 164283, (3) 10235321, (4) 1329, (5) 67282, (6) 5364321, . . . , it is when the random number (5) 67282 which is within the third segment appears that a random number is used to choose a combination of the symbols. The random number is converted into an identification number by dividing the random number by the total number of the combinations to give the remainder, 1746 and choosing the combination identified by the same number. Specifically, the combination chosen by the identification number 1746 comprises a 2nd stop position of the first reel, a 23rd stop position of the second reel, and a 19th stop position of the third reel, i.e., [2 23 19], and this combination is chosen. In this way, combinations of the symbols are chosen for the following games, and when 32768 games are finished, all the combinations have been chosen. At this time, a resultant pay out agrees with an original pay out ratio. By using the concept of the segmentation in this way, a pay out ratio can be converged without fail in a period of time in which each of the symbols appears once (in about 16 days assuming that 2000 games are played a day).

After all the random numbers in the third segment have been used up, another segment is chosen at random and only when a random number in the segment appears, the random number is used to choose a combination of the symbols. The combination of the symbols chosen this time has a completely different sequential order of combination from that chosen out of the third segment. In the same way, combinations of the symbols having 512 different sequential orders can appear unrepeatedly one by one. As described above, it takes 23 years for all the combinations to appear on the assumption that 2000 games are played a day.

In the above described case, one segment is chosen. But it is possible to choose 2 or more segments. The period of time in which a pay out ratio converges differs, depending on the number of chosen segments. For example, assuming that two segments are chosen, the period of time required for a pay out ratio to converge is twice that for the case where one segment is chosen. Thus it is possible to adjust the period of time in which a pay out ratio will converge.

Besides, by adjusting the number of chosen segments, it is also possible to roughly adjust an uneven distribution of wins. Specifically, assuming that one of all the combinations of the symbols is set as a win which pays a maximum number of coins, when n segments are chosen, there is a possibility that the winning combinations appear concentratedly n times in a short period of time while all the combinations of the symbols appear n times. Assuming that 1 segment, i.e., the minimum number of segments is chosen, the winning combination appears only once in that one segment. Thus, by decreasing the number of segments, it is possible to distribute wins of high values.

The generation of a random number described above as well as the control of the reels 5,6,7 and the display section 3 is executed by CPU 22.

Figure 3:
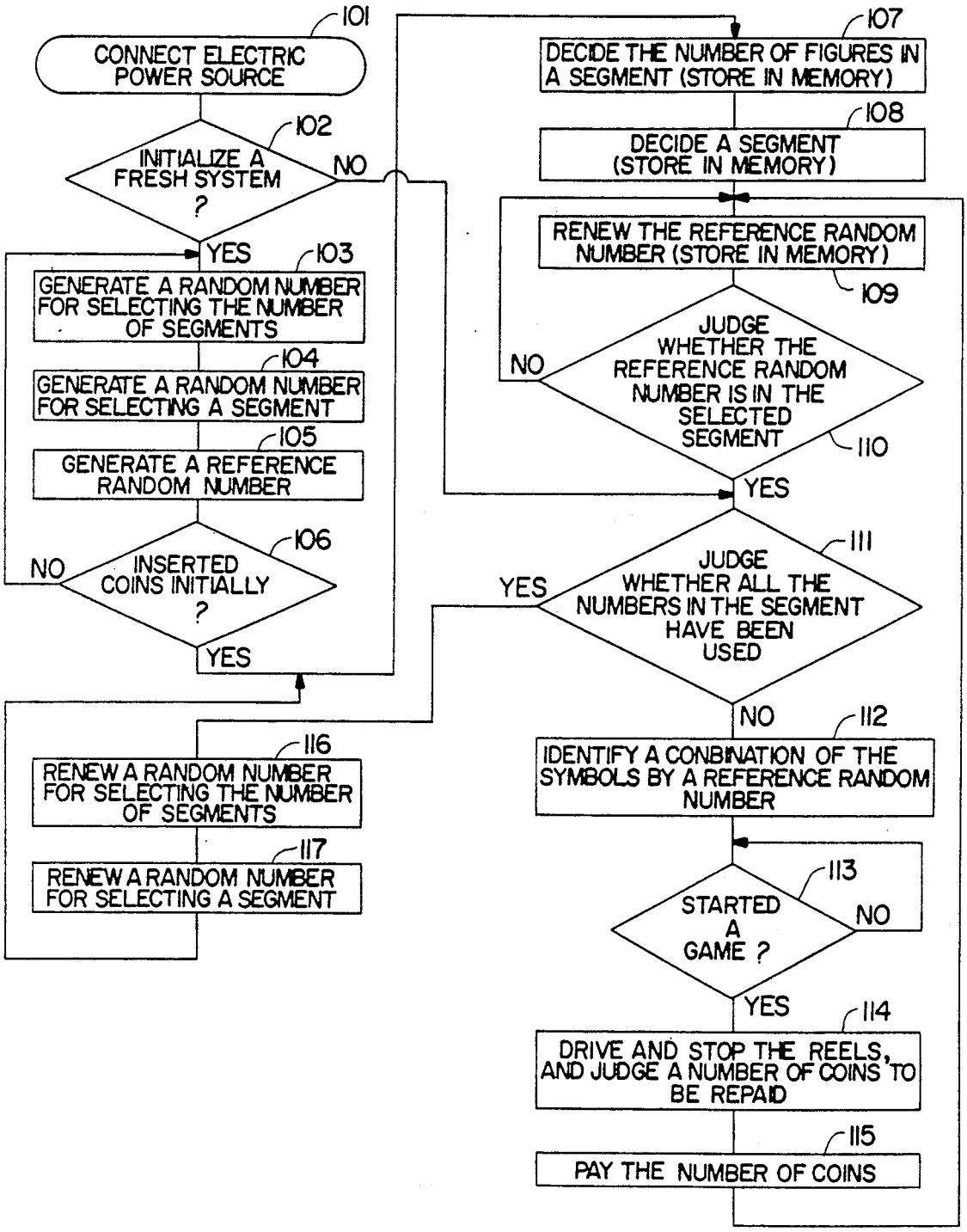
FIG. 3 is a flow chart of the operation of the slot machine according to the embodiment.

Next, the operation of this embodiment will be explained in good detail with reference to the flow chart of FIG. 3, i.e., the flow chart shown the operation of CPU 22.

First, when an electric power source is connected (Step 101), it is judged whether or not it is for a fresh system start (Step 102). The fresh system start means that a fresh slot machine just after fabrication is initially actuated. Accordingly, it is not called a fresh system start to reactuate the slot machine after cutting down the power after initial actuation. But in the situation where there is a long of disconnection from the power source, exceeding a memory retaining hour (e.g., 1 month), the slot machine is again connected to the power source, the connection is judged a fresh system start.

When a connection to the power source is judged a fresh system start, an initializing operation is made (Steps 103~106). That is, a random number for selecting the number of segments is generated (Step 103). For example in Step 103, one number out of 1~4 is generated. Next, in step 104, a random number or numbers are generated for selecting one or more segments out of the 1st to 512th segments with the number of segments selected dependent upon the number selected in Step 103. The segment number or numbers generated in Step 104 are selected at random and unrepeatedly. When all the figures from the segments chosen in Step 104 have been used up, the same number of segments determined in step 103 are generated out of a new number sequence from 1 to 512 at random and unrepeatedly. Then one random number is generated from the 24 bit M sequence random numbers (Step 105). The random number is a reference for selecting a combination of the symbols and is called the reference random number. The processings from Step 103 to Step 105 are repeated until coins are inserted initially. That is, the initial insertion of coins ends the initialization. The first insertion of coins means that coins are inserted initially after the system is initialized. Practically, coins are inserted initially during a test run of the slot machine. The processings of Steps 103 to 105 are repeated at a speed of 1,000 times or more every second. Accordingly, since it is almost unlikely that they are initially fed with coins at the same time even if a plurality of the slot machines are simultaneously connected to the power source, it is almost impossible that a plurality of the slot machines operate based on the same random number. Wins are sufficiently distributed among the slot machines. In this embodiment, the initialization is ended by the initial insertion of coins but may be ended by pushing an exclusive switch or the like.

When coins are initially inserted, a random number for selecting the number of segments generated in Step 103 is stored by RAM 24 (Step 107). A random number for selecting a segment generated in Step 104 is stored by RAM 24 as the number of the segment to be selected (Step 108). Then the reference random number generated in Step 105 is renewed, and a renewed number is stored in RAM 24 (Step 109).

Subsequently, it is judged whether the reference random number stored in Step 109 is in the segment identified by the number stored in Step 108 (Step 110). When it is denied, Step 109 is repeated to renew the reference random number, and a renewed reference random number is judged in Step 110. The renewal of a reference random number is continued until a renewed reference random number agrees with any one of the numbers in a segment stored in Step 108. When it is affirmed in Step 110, it is judged whether all the numbers in the segment have been used to decide a combination of the symbols (Step 111). Specifically, it is judged whether the reference random number affirmed in Step 110 has been used as a random number for deciding a combination of the symbols. When it is judged that the reference random number has not been used, a combination of the symbols corresponding to the reference random number is decided (Step 112). That is, a combination of the symbols identified by the same number as a remainder given by dividing the reference random number by the total number of the combinations of the symbols is selected. Then, the slot machine waits for a player to make a required game starting operation (Step 113).

When a game starting operation is made, the reels 5, 6, 7 are simultaneously started to rotate and stopped one after another so that the combination selected in Step 112 may appear. At this time, numbers of coins to be repaid is judged in accordance with the combination of the symbols, based on a preset schedule (Step 114). After the reels 5, 6, 7, are stopped, the number of coins corresponding to the judgement is paid (Step 115). After the number of coins are repaid, the processings from Step 109 to Step 115 are repeated.

In Step 111, when it is judged that a reference random number has been used as a number for selecting a combination of the symbols, the random number for selecting the number of segments, and the random number for selecting a segment are renewed (Steps 116 and 117), and Step 107 is repeated.

The flow of the operation of CPU 22 in this embodiment has been described. The above described flow is an abstract of the operation of this invention, and the details of the operation are omitted.

Figure 4:
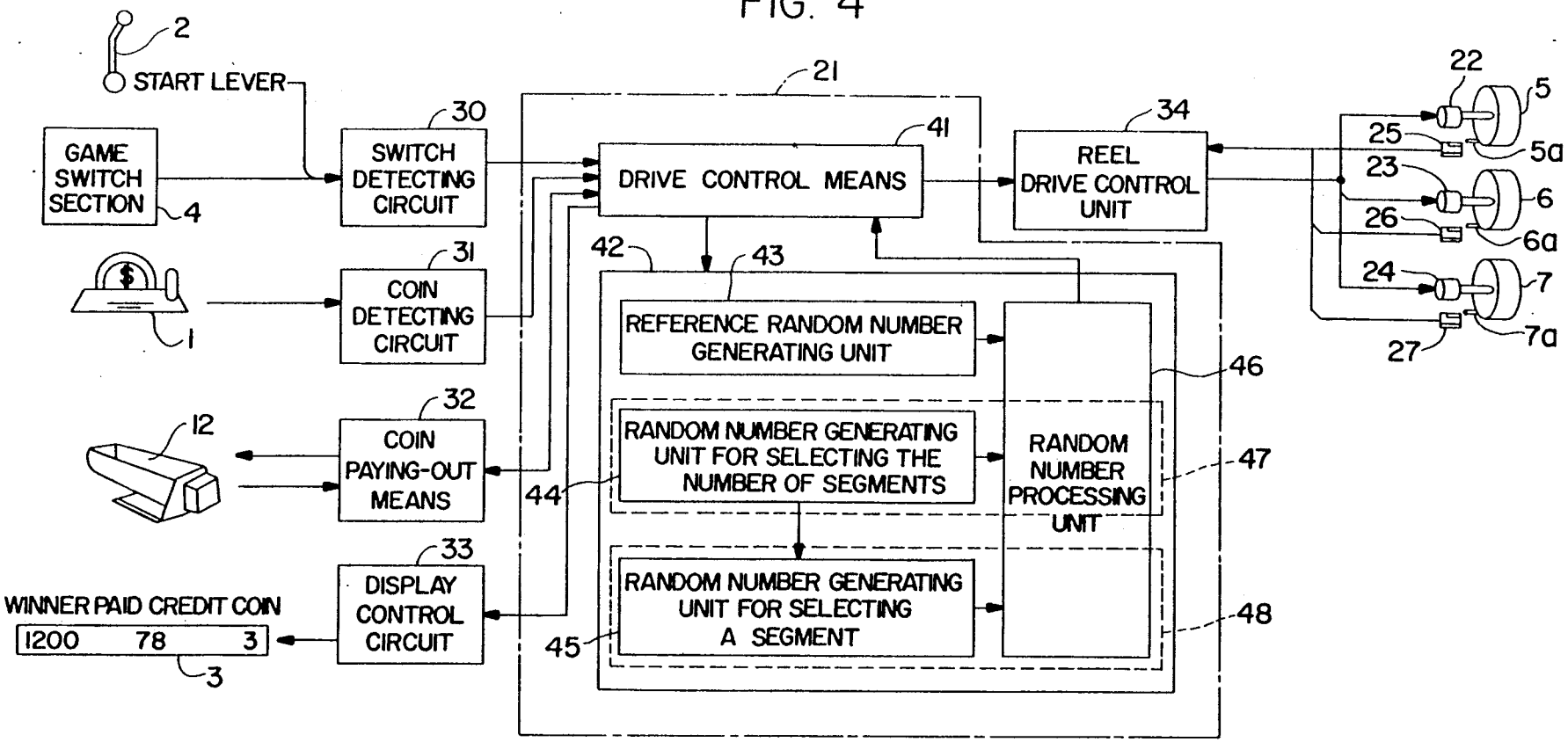
FIG. 4 is a block diagram of the operation of the microcomputer 21 in FIG. 2.

FIG. 4 is a block diagram showing the function of the microcomputer 21 which makes the above described operation. The microcomputer 21 comprises drive control means 41 and random number generating means 42. The drive control means 41 controls the coin paying out means 32 and the reel drive control circuit 34, based on the informations supplied by the switch detecting circuit 30, coin detecting circuit 31 and the random number generating means 42 which are disposed outside.

The random number generating means 42 comprises a reference random number generating unit 43, a random number generating unit for selecting the number of segments 44, a random number generating unit for selecting a segment 45, and a random number processing unit 46. The reference random number generating unit 43 generates a reference random number as a 24 bit M sequence random number. The random number generating unit for selecting the number of segments 44 generates one number out of 1 to 4 at random. The random number generating unit for selecting a segment 45 generates at random and unrepeatedly out of the number sequence from 1 to 512 the same number of segments as the number generated by the random number generating unit for selecting the number of segments 44.

The random number processing unit 46 stores a random number generated by the random number generating unit for selecting the number of segments 44 and the random number generating unit for selecting a segment 45. The random number generating unit for selecting the number of segments 44 and the random number processing unit 46 make up means for selecting a number of segments 47. The random number generating unit for selecting a segment 45 and the random number processing unit 46 make up segment selecting means 48. The random number processing unit 46 judges whether or not a random number generated by the reference random number generating unit 43 is a random number for selecting a segment (Step 110 in the flow chart), and whether or not the random number has been used to select a combination of the symbols (Step 111 in the flow chart). When both are satisfied, the reference random number is adopted as a random number for selecting a combination of the symbols, and the random number is subjected to the above described calculation to give an identification number. The identification number is supplied to the drive control means 41. When the required conditions for starting a game are met, the drive control means 41 energizes the reel drive control circuit 34 to rotate the reels and stop the reels so that the combination of the symbols identified by the number supplied by the random processing unit 46 may appear. Then the drive control means 41 commands the coin paying out means 32 to pay a number of coins corresponding to the combination of the symbols.

In this embodiment, the 24 bit M sequence random numbers are used as reference random numbers, and selective numbers are generated at random and unrepeatedly out of the natural number sequence from 0 to 16777215. But any random number may be used as long as selective numbers are generated at random and unrepeatedly out of a certain segment of a natural number sequence. In the case where M sequence random numbers are used, the number of bits may be suitably changed. The number of reference random numbers may be equal to a total number of combinations of the symbols by adjusting the number of bits. In this case, a segment has the same number sequence as that making up the reference random numbers, and the number of segments is 1. There is no room for selecting a segment.

In this embodiment, the number of segments selecting means 47 selects at random a number out of 1 to 4, but the number may be selected suitably. It may be possible that the same number, e.g., only 1 or only 2, is always selected.

In the case where the number of segments selecting means 47 always selects a total number of the segments, all the random numbers generated by the reference number generating unit 43 become valid and can be used to select combinations of the symbols.

In this embodiment, the segments are provided by dividing the number sequence making up the reference random numbers with no interval between each segment and a next one. But the segments may be ones that are selectively extracted from a number sequence making up the reference random numbers and have the same number of figures as the total number of combinations of the symbols.

In this embodiment, the segment selecting means selects more than one or two out of a plurality of preset segments at random and unrepeatedly. But one segment may be selected repeatedly. In this case the convergence of a pay out ratio is not adversely affected, but in view of the long term randomness, it is preferable to select a segment unrepeatedly.

The number of reels is not limited to three. The number of symbols drawn on one reel is not limited to thirty two. A blank is counted as an undepicted symbol.

The slot machine according to this embodiment uses mechanical reels, but the slot machine according to this invention may be used in the video slot machine.

The video slot machine displays an equivalent to the displays appearing in the display windows 8, 9, 10, i.e., picture which appear as if reels having a plurality of symbols arranged thereon were rotated and stopped, using an electrical display device, e.g., a CRT display device. According to this invention, such video slot machine has a plurality of reels having a plurality of symbols arranged thereon.

I claim:

1. A slot machine, comprising:

a plurality of reels with each reel having a plurality of symbols arranged thereon;

means for displaying said symbols;

means for assigning a distinguishing identifier to each and every combination of symbols among the reels when one symbol of each reel is selected;

storage means for storing the assigned distinguishing identifiers;

identifier selection means for selecting one of the distinguishing identifiers stored in said storage means;

means for stopping said reels in accordance with the selected distinguishing identifier such that the combination of symbols represented by said distinguishing identifier is displayed by said means for displaying;

said distinguishing identifiers being numbers and said identifier selection means including random number generator means for generating a random number which is representative of said one of the distinguishing identifiers;

said random number generating means comprising a reference random number generating means and a random number processing means;

said reference random number generating means having means for generating a reference random number from a predetermined length of a natural number sequence which extends without repeating each generated random number;

said random number processing means having means for setting a plurality of non-overlapping preset segments of said predetermined length of a natural number sequence, said preset segments having the same number of natural numbers as the total number of distinguishing identifiers; and segment selecting means for selecting one preset segment out of said plurality of preset segments, said identifier selection means utilizing a reference random number generated by said reference random number generating means only when the reference number is in the preset segment selected by said segment selecting means, and said reference random number generating means continues to generate a new random number in one play until a random number generated by said reference random number generating means is processed by said identifier selection means as a random number for selecting a distinguishing identifier.

2. A slot machine according to claim 1, wherein said reference random number generating unit generates M sequence random numbers.

3. A slot machine according to claim 2, wherein said segment selecting means selects one preset segment at random out of said plurality of said preset segments, and another preset segment is selected by said segment selection means after all the numbers in said one preset segment have been chosen to represent distinguishing identifiers by said identifier selection means.

4. A slot machine according to claim 2, wherein said segment selecting means selects one preset segment at random and unrepeatedly out of said plurality of said preset segments, and another preset segment is selected by said segment selecting means after all the numbers in said one preset segment have been chosen to represent distinguishing identifiers by said indentifier selection means.

5. A slot machine according to claim 2, wherein there is provided segment selecting means for selecting two preset segments or more out of said plurality of said preset segments, said identifier selection means utilizing a random number generated by said reference random number generating means as a random number for selecting a distinguishing identifier only when the random number is in said two or more preset segments selected by said segment selecting means; and said reference random number generating means continues to generate a new random number in one play until a random number generated by said reference random number generating means is processed by said identifier selection means as a random number for selecting a distinguishing identifier.

6. A slot machine according to claim 5, wherein there is provided means for selecting at random the number of preset segments to be set by said random number processing means; and said segment selecting means selects one or more of the preset segments from the random number of preset segments determined by said means for selecting at random the number of preset segments.

7. A slot machine according to claim 6, wherein said segment selecting means selects at random two or more preset segments out of said plurality of said preset segments; and said segment selecting means and said means for selecting at random the number of preset segments make another selection after all the numbers in the selected two or more preset segments have been chosen to represent distinguishing identifiers by said identifier selection means.

8. A slot machine according to claim 6, wherein said segment selecting means selects at random and unrepeatedly two or more preset segments out of said plurality of said preset segments; and said segment selecting means and said means for selecting at random the number of preset segments make another selection after all the numbers in the selected two or more segments have been chosen to reprsent distinguishing identifiers by said identifier selection means.

9. A slot machine according to claim 1, wherein said segment selecting means selects one preset segment at random out of said plurality of said preset segments, and another preset segment is selected by said segment selection means after all the numbers in said one preset segment have been chosen to represent distinguishing identifiers by said identifier selection means.

10. A slot machine according to claim 1, wherein said segment selecting means select one preset segment at random and unrepeatedly out of said plurality of said preset segments, and another preset segment is selected by said segment selecting means after all the numbers in said one preset segment have been chosen to represent distinguishing identifiers by said identifier selection means.

11. A slot machine according to claim 1, wherein there is provided segment selecting means for selecting two preset segments or more out of said plurality of said preset segments, said identifier selection means utilizing a random number generated by said reference random number generating means as a random number for selecting a distinguishing identifier only when the random number is in said two or more preset segments selected by said segment selecting means, and said reference random number generating means continues to generate a new random number in one play until a random number generated by said reference number generating means is processed by said identifier selection means as a random number for selecting a distinguishing identifier.

12. A slot machine according to claim 11, wherein there is provided means for selecting at random the number of preset segments to be set by said random number processing means; and said segment selecting means selects the preset segments from the random number of preset segments determined by said means for selecting at random the number of preset segments.

13. A slot machine according to claim 12, wherein said segment selecting means selects at random two or more preset segments out of said plurality of said preset segments; and said segment selecting means and said means for selecting at random the number of preset segments make another selection after all the numbers in the selected two or more preset segments have been chosen to represent distinguishing identifiers by said identifier selection means.

14. A slot machine according to claim 12, wherein said segment selecting means selects at random and unrepeatedly two or more preset segments out of said plurality of said preset segments; and said segment selecting means and said means for selecting at random the number of segments make another selection after all the numbers in the selected two or more preset segments have been chosen by said identifier selection means to represent distinguishing identifiers.

15. A slot machine, comprising:

a plurality of reels with each reel having a plurality of stop positions;

means for assigning a distinguishing identifier to each and every combination of stop positions among the reels when one stop position of each reel is selected, and said distinguishing identifiers being a sequence of positive integers of predetermined length (L1);

storage means for storing the assigned distinguishing identifiers;

identifier selection means for selecting one of the distinguishing identifiers stored in said storage means;

means for stopping said reels in accordance with the selected distinguishing identifier;

said identifier selection means including a random number generator means which generates for each game, at random and without repeating each generated number, one selective number out of a predetermined length (L2) of a natural number sequence which is made up of positive integers; and means for setting a plurality of preset segments without overlapping one another in said predetermined length (L2) of the natural number sequence, and said means for setting a plurality of preset segments including means for determining the number of preset segments based on the ratio of (L2/L1).

16. A slot machine, comprising:

a plurality of reels with each reel having a plurality of stop positions;

means for assigning a distinguishing identifier to each and every combination of stop positions among the reels when one stop position of each reel is selected, and said distinguishing identifiers being a sequence of positive integers of predetermined length (L1);

storage means for storing the distinguishing identifiers;

identifier selection means for selecting one of the distinguishing identifiers stored in said storage means;

means for stopping said reels in accordance with the selected distinguishing identifier;

said identifier selection means including a random number generator means which generates for each game, at random and without repeating each generated number, one selective number out of a predetermined length (L2) of a natural number sequence which is made up of positive integers; and means for setting preset segments (A) in said predetermined length (L2) of the natural number sequence, a length (L3) of each of the preset segments (A) being equal to said predetermined length (L1) of said distinguishing identifiers, whereby only when a random number generated for each game is in a predetermined one of said preset segments does said identifier selection means select a distinguishing identifier corresponding to said generated random number.

* * * * *